US005204483A

United States Patent [19]

Tellechea

[11] Patent Number: 5,204,483

[45] Date of Patent: Apr. 20, 1993

[54] GUN BARREL CLEANING DEVICE

[76] Inventor: Albert F. Tellechea, Centruy Plaza, 135 W. Central Blvd., Suite 850, Orlando, Fla. 32801

[21] Appl. No.: 862,213

[22] Filed: Apr. 2, 1992

[51] Int. Cl.[5] ..... F41C 31/00

[52] U.S. Cl. ..... 42/95; 42/90

[58] Field of Search ..... 175/325.3; 42/95, 90; 384/300

[56] References Cited

U.S. PATENT DOCUMENTS

| | | | |
|---|---|---|---|
| 790,330 | 5/1905 | Terry | 175/325.3 |
| 1,490,038 | 4/1924 | Smith | 42/95 |
| 1,651,088 | 11/1927 | Fentress | 175/325.3 |
| 1,877,395 | 9/1932 | Goeser | 175/325.3 |
| 1,888,216 | 11/1932 | Bull | 175/325.3 |
| 3,104,134 | 9/1963 | Nielsen et al. | 175/325.3 |
| 3,109,501 | 11/1963 | Pugh | 175/325.3 |
| 4,380,347 | 4/1983 | Sable | 175/325.3 |
| 4,582,368 | 4/1986 | Fujita et al. | 384/300 |
| 4,603,982 | 8/1986 | Dittrich | 384/300 |
| 4,803,792 | 2/1989 | Brown et al. | 42/95 |

*Primary Examiner*—David H. Brown
*Attorney, Agent, or Firm*—Ezra Sutton

[57] ABSTRACT

A device for cleaning the barrel of a gun, which includes a shaft having a plurality of cylindrical members and bushings to prevent the shaft from scraping the internal surface of the barrel during cleaning.

24 Claims, 2 Drawing Sheets

GUN BARREL CLEANING DEVICE

FIELD OF THE INVENTION

This invention relates to a shaft for cleaning the barrel of a gun which avoids marring or scraping the internal surfaces of the gun barrel.

BACKGROUND OF THE INVENTION

Several devices for cleaning the barrel of a shotgun have been designed in previous years. U.S. Pat. No. 4,726,137 to Zurek discloses a motor-driven gun cleaning rod, wherein a motor is attached to the end of the rod. However, there is no provision to prevent barrel scraping due to irregular rotation within the barrel.

A system described in U.S. Pat. No. 4,930,240 to Bice shows a gun barrel cleaning rod that has sections and is designed to be attachable to an electric screwdriver. Threaded interconnects are provided for making cleaning rods of different lengths, and they are not larger than the diameter of the remainder of the rod to prevent barrel scraping.

U.S. Pat. No. 5,050,331, issued to Burkhalter, has a cleaning rod for a pistol with a crank on the end that allows the rod to be moved in and out for cleaning. A West German patent to Mert shows a manually-operated cleaning rod that uses couplings between sections. U.S. Pat. No. 4,901,465 to Hsu displays a sectionalized rifle gun cleaning rod. U.S. Pat. No. 2,544,150 to Franklin discloses a deformable wiper for firearm bores. U.S. Pat. No. 4,962,607 to Baldwin shows a smooth bore cleaning rod with an elastomeric cleaning nose. Finally, U.S. Pat. No. 4,674,218 to Bottomley discloses another gun cleaning rod which also has threaded interconnects between sections, but the interconnects are only for the purpose of changing the size of the rod and not for preventing barrel scraping.

Although there are several motorized cleaning rods in the prior art and some with interconnecting sections, none of them prevent barrel scraping.

Accordingly, it is an object of the present invention to provide a cleaning rod or shaft which prevents scraping of the gun barrel.

It is also an object to provide bushings on the cleaning rod which simply and economically prevent scraping of a gun barrel.

SUMMARY OF THE INVENTION

In accordance with the principles of the present invention, there is provided a device for cleaning the barrel of a shotgun comprising a plurality of cylindrical members which cooperate to form a shaft when attached in an end-to-end manner. There is also provided a plurality of bushings mounted on the members of the shaft for preventing the shaft from scraping the internal surface of the gun barrel during cleaning.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT

The internal diameter of the unchoked barrel of a shotgun is also known as the bore. A 10 gauge shotgun, capable of hurling a pure lead ball weighing 1/10 of a pound or 1.6 ounces, has a bore or internal diameter of 0.775 of an inch. This bore is also the caliber of the firearm. Shotguns, with the exception of the .410, have traditionally been classified by gauge and not caliber. All other firearms are classified by caliber. For example, a .45 caliber pistol has a bore of 0.450 of an inch at the point where the projectile exits the barrel; a ".357 magnum" has an initial barrel diameter of 0.380 of an inch tapering down to 0.357 of an inch at the exit point (that is why a .357 caliber firearm is considered a dual caliber weapon in that it will discharge a .357 or .38 caliber projectile). In large caliber weapons, the bore is measured in millimeters or in inches. For example, a 105 mm cannon has a bore of 10.5 cm or 105 mm; the 16 inch gun in a battleship has a bore of 1 foot, 4 inches.

INTERIOR DIAMETERS OR BORES OF A TYPICAL CHOKE

| Gauge | Full | Improved/ Modified | Modified | Improved/ Cylinder | Cylinder |
|---|---|---|---|---|---|
| 10 | 0.739 | 0.748 | 0.757 | 0.766 | 0.775 |
| 12 | 0.693 | 0.702 | 0.711 | 0.720 | 0.729 |
| 16 | 0.636 | 0.6425 | 0.649 | 0.6555 | 0.662 |
| 20 | 0.589 | 0.5955 | 0.602 | 0.6085 | 0.615 |
| 28 | 0.530 | 0.535 | 0.540 | 0.545 | 0.550 |
| 67 | 0.390 | 0.395 | 0.400 | 0.405 | 0.410 |

Figure 1:
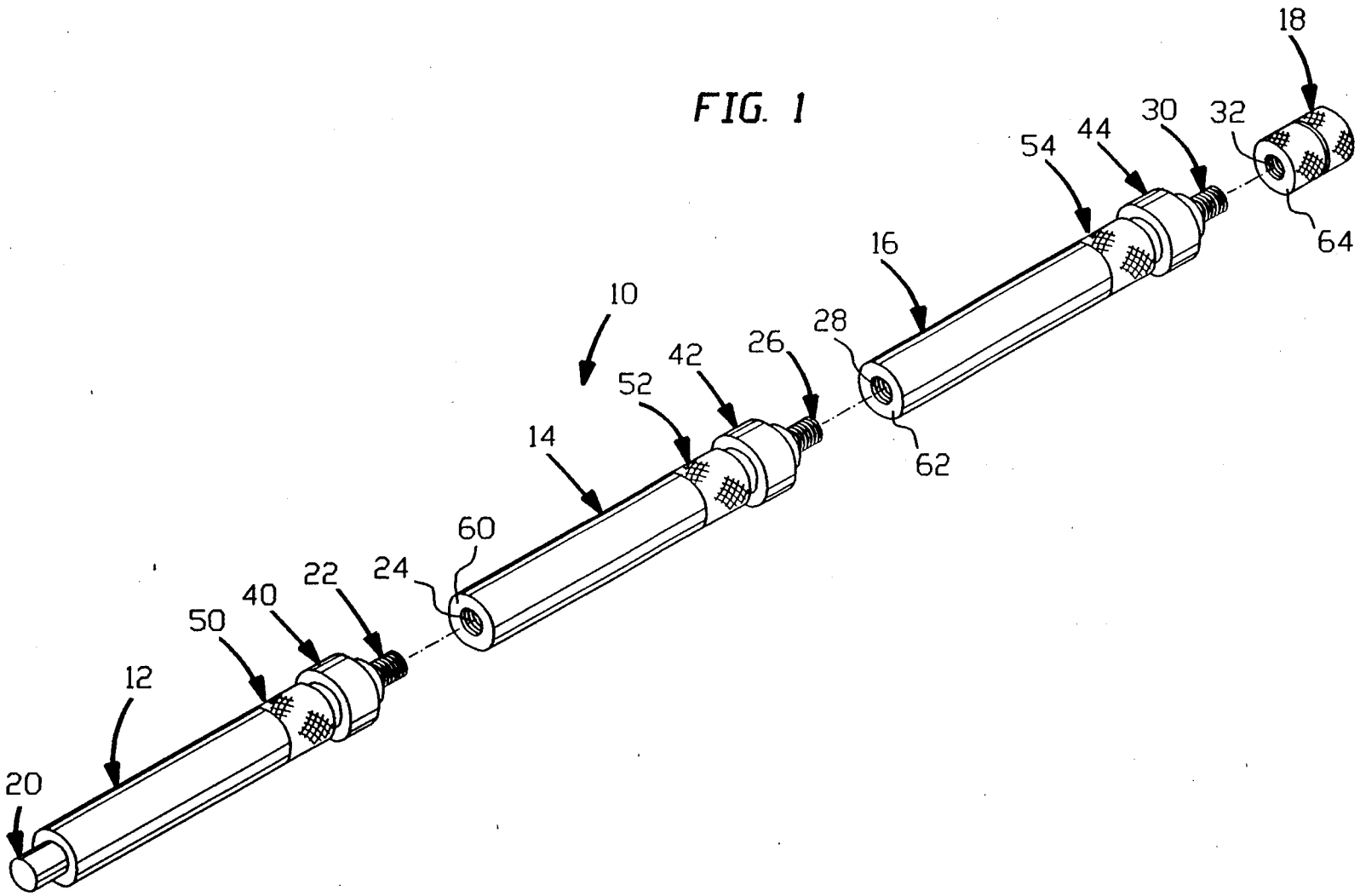
FIG. 1 is a perspective view of a disassembled shaft, showing how the individual members attach in an end-to-end manner.
Figure 2:
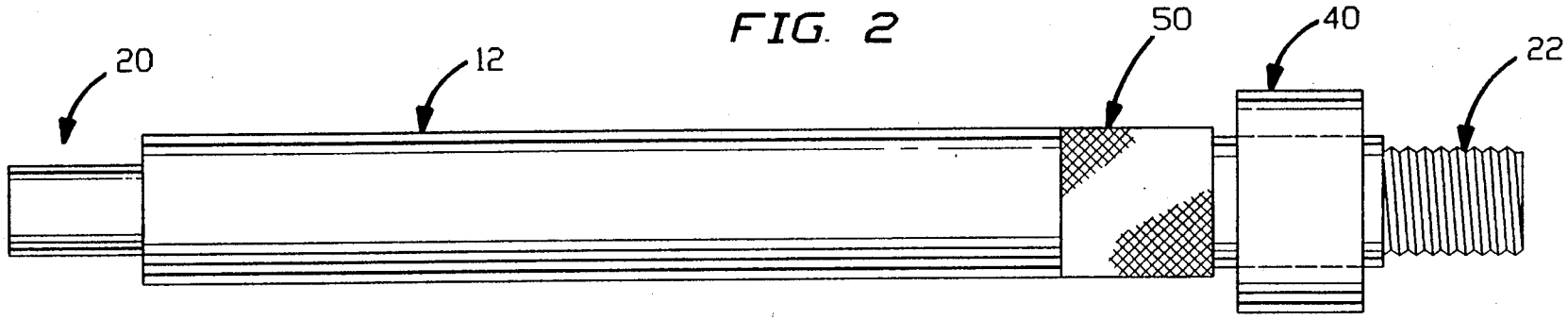
FIG. 2 is a side elevational view of the first member of the shaft and a bushing mounted on one end thereof.
Figure 3:
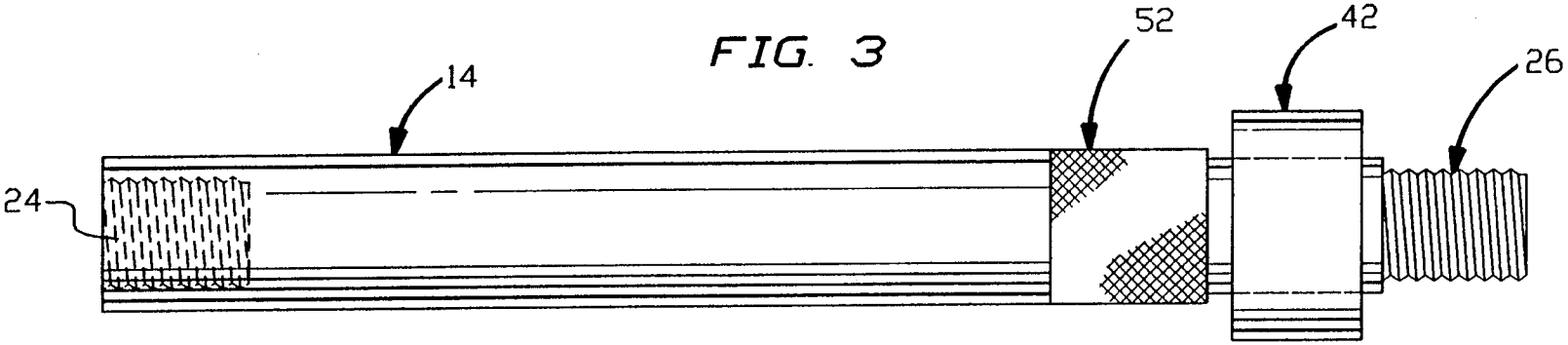
FIG. 3 is a side elevational view of the second member of the shaft, also with a bushing mounted on one end thereof.
Figure 5:
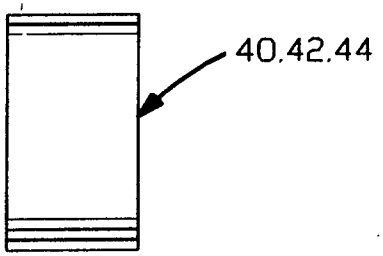
FIG. 5 is a side elevational view of the bushing of the prevent invention.

Referring to FIG. 1, there is shown a shaft 10 embodying the principles of the present invention. The shaft 10 is formed by attaching a plurality of cylindrical members 12, 14, 16, and 18 in an end-to-end manner.

The first member 12 of shaft 10 has an extension 20 for attaching a cleaning mechanism to it, and it has a threaded extension 22 for attaching member 12 to threaded bore 24 of member 14. Member 14 has a threaded section 26 for attaching member 14 to threaded bore 28 of member 16.

Figure 4:
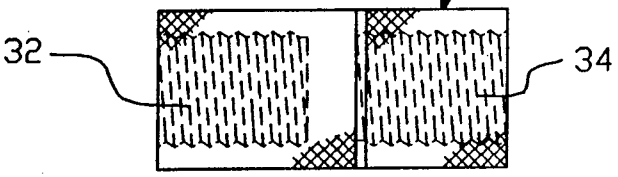
FIG. 4 is a side elevational view of an adaptor member.

Referring to FIG. 1, there is shown an adaptor member 18 having a threaded bore 32 for attaching member 18 to threaded extension 30 of member 16. AS shown in FIG. 4, member 18 has a threaded bore 34 for attaching a driving system thereto for driving shaft 10 in the barrel of a shotgun. Preferably, members 12, 14, 16, and 18 are formed of stainless steel, or in some cases, of aluminum, or other metal, or plastic.

Referring to the drawings, there is shown a first bushing 40 mounted on member 12, a second bushing 42 mounted on member 14, and a third bushing 44 mounted on member 16. Bushings 40, 42, and 44 are rotatably and removably mounted on members 12, 14, and 16, respectively. The bushings may move longitudinally only slightly because of adjacent abutments. Knurled surfaces 50, 52, and 54 act as an abutment to the left of bushings 40, 42, and 44, respectively. Also, abutments are formed to the right by the ends 60, 62, and 64 of respective members 14, 16, and 18. The bushings 40, 42, and 44 prevent shaft 10 from scraping the internal surface of the gun barrel during cleaning. Preferably, bushings 40, 42, and 44 are made of Delrin or a similar material, such as Teflon.

Preferably, the bushings should have an external diameter as close as possible to the internal diameter or bore of the barrel. On a 12 gauge, the production bushing is approximately 0.050 of an inch or 1.27 mm smaller than the bore. This translates into a clearance between the bushing and the barrel of approximately 0.025 of an inch or 0.635 mm.

The above relationship dictates a reduction in shaft diameter for the 28 gauge level in order to enable the production of a bushing for said shaft. The shaft diameter of the cleaning rod for the 28 gauge and the .410 barrel have an external diameter of ¼ of an inch (0.250 of an inch). The bushing shoulder is machined to an external diameter of 0.189 of an inch, and it is threaded in 10/32 for both the male and female portions. The accessory adapter 18 has a female thread in 10/32 and an opposite end thread to accommodate the thread of the common accessories used to clean the 28 gauge and .410 caliber shotguns.

The following table contains the measurements to reflect the external and internal diameters of the bushings for the cleaning shaft 10. As mentioned above, the cleaning shaft for the 28 gauge and the .410 caliber shotguns have an external diameter of 0.250 of an inch and not 0.375 of an inch (¼ of an inch as opposed to ⅜ of an inch, respectively). The cleaning shaft 10 is designed to clean the entire barrel without the need to push the cleaning accessory out of the exit end. Just in case the gun owner by mistake pushes the shaft past the exit end of the barrel, the external diameter of the bushing is designed so that its external diameter is smaller than the internal diameter of the full choke for the particular gauge or caliber of the shotgun being cleaned. For example, the external diameter of the bushing for the cleaning shaft for a 12 gauge shotgun is 0.679; the internal diameter for the full choke for the 12 gauge shotgun is 0.693, for a lateral clearance of 0.007 of an inch or 0.356 mm.

All dimensions given in the following table are in decimals of inches.

| Gauge | Bore | External Diameter of Bushings | Internal Diameter of Bushings |
|---|---|---|---|
| 10 | 0.775 | 0.725 | 0.320 |
| 12 | 0.729 | 0.679 | 0.320 |
| 16 | 0.662 | 0.612 | 0.320 |
| 20 | 0.615 | 0.565 | 0.320 |
| 28 | 0.550 | 0.500 | 0.189 |
| 67 | 0.410 | 0.360 | 0.189 |

Advantageously, there has been provided in accordance with the present invention a simple and inexpensive manner in which to prevent cleaning shafts from scraping or marring the internal surfaces of a gun barrel.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A device for cleaning the barrel of a gun in combination with a gun barrel cleaning mechanism, comprising:

a) a shaft formed by attaching a plurality of cylindrical members in an end-to-end manner;

b) a first cylindrical member of said shaft having first means for attaching said gun barrel cleaning mechanism at the first end thereof and having second means on the second end thereof for attaching said first cylindrical member to a second cylindrical member;

c) a second cylindrical member of said shaft having first means at the first end thereof for connecting said second cylindrical member to said first cylindrical member and having second means at the second end thereof for attaching said second cylindrical member to another member of said shaft;

d) an adaptor member including means for attachment to said first or second cylindrical member of said shaft and including means for connecting a driving system thereto for driving said shaft in the barrel of a shotgun; and e) a plurality of bushings mounted on said first and second cylindrical members for preventing said shaft from scraping the internal surface of the gun barrel during cleaning.

2. A device in accordance with claim 1, wherein said bushings having a larger external diameter than the external diameter of said shaft.

3. A device in accordance with claim 1, wherein said bushings are removably mounted on said first and second cylindrical members.

4. A device in accordance with claim 1, wherein said bushings are rotatably mounted on said first and second cylindrical members.

5. A device in accordance with claim 1, wherein said bushings are made of Delrin.

6. A device in accordance with claim 1, wherein said bushings are made of Teflon.

7. A device in accordance with claim 1, wherein the external diameter of said bushings is at least 50% greater than the external diameter of said shaft.

8. A device in accordance with claim 1, wherein said first and second cylindrical members include means for preventing substantial longitudinal movement of said bushings.

9. A device in accordance with claim 1, wherein said first and second cylindrical members include abutment means for preventing substantial longitudinal movement of said bushings.

10. A device in accordance with claim 1, wherein said first means of said first cylindrical member and said first means of said second cylindrical member are threaded means.

11. A device in accordance with claim 1, wherein said first and second cylindrical members of said shaft are made of aluminum, steel, or other metal.

12. A device in accordance with claim 1, wherein said cylindrical members are made of plastic material.

13. A device in accordance with claim 1, further including a third cylindrical member having first means at the first end thereof for connecting said third cylindrical member to said second cylindrical member and having second means at the second end thereof for joining with another member of said shaft.

14. A device for cleaning the barrel of a gun in combination with a gun barrel cleaning mechanism, comprising:

a) a first shaft insertable within a gun barrel having a first end, a second end, and an exterior surface;

b) said first end having means for attaching said first shaft to said gun barrel cleaning mechanism; and c) a first bushing mounted on said exterior surface of said first shaft for maintaining the spacing of said first shaft from the internal surface of said gun barrel.

15. A device in accordance with claim 14, wherein said first bushing has a larger external diameter than the external diameter of said first shaft.

16. A device in accordance with claim 14, wherein said first bushing is removably mounted on said first shaft.

17. A device in accordance with claim 14, wherein said first bushing is rotatably mounted on said first shaft.

18. A device in accordance with claim 14, wherein said first bushing is made of Delrin.

19. A device in accordance with claim 14, wherein said first bushing is made of Teflon.

20. A device in accordance with claim 14, wherein the external diameter of said first bushing is at least 50% greater than the external diameter of said first shaft.

21. A device in accordance with claim 14, wherein said first shaft includes means for preventing substantial longitudinal movement of said firs bushing.

22. A device in accordance with claim 14, wherein said first shaft includes abutment means for preventing substantial longitudinal movement of said first bushing.

23. A device in accordance with claim 14, further including:

a) a second shaft insertable within a gun barrel having a first end, a second end, and an exterior surface;

b) said first end of said second shaft having means for attaching said second shaft to said first shaft;

c) said second end of said second shaft having means for attaching said second shaft to another member; and d) a second bushing mounted on said exterior surface of said second shaft for maintaining the spacing of said second shaft from the internal surface of said gun barrel.

24. A device in accordance with claim 23, further including:

a) a third shaft insertable within a gun barrel having a first end, a second end, and an exterior surface;

b) said first end of said third shaft having means for attaching said third shaft to said second shaft;

c) said second end of said third shaft having means for attaching said third shaft to another member; and d) a third bushing mounted on said exterior surface of said third shaft for maintaining the spacing of said third shaft from the internal surface of said gun barrel.

* * * * *

UNITED STATES PATENT AND TRADEMARK OFFICE

CERTIFICATE OF CORRECTION

PATENT NO. : 5,204,483

DATED : April 20, 1993

INVENTOR(S) : ALBERT F. TELLECHEA

It is certified that error appears in the above-identified patent and that said Letters Patent is hereby corrected as shown below:

Column 3, line 32, change "3/4" to --3/8--.

Column 5, line 29, change "firs" to --first--.

Signed and Sealed this

Twenty-eighth Day of December, 1993

*Attest:*

*Attesting Officer*

BRUCE LEHMAN

*Commissioner of Patents and Trademarks*